US006425278B1

(12) United States Patent
Aratani et al.

(10) Patent No.: US 6,425,278 B1
(45) Date of Patent: Jul. 30, 2002

(54) ROLL CHANGING APPARATUS OF ROLLING MILL

(75) Inventors: Hiroshi Aratani; Hisao Matsushima; Mikio Yamamoto; Yoshiki Mito, all of Hiroshima (JP)

(73) Assignee: Mitsubishi Heavy Industries, Ltd, Tokyo (JP)

( * ) Notice: Subject to any disclaimer, the term of this patent is extended or adjusted under 35 U.S.C. 154(b) by 0 days.

(21) Appl. No.: 09/715,190

(22) Filed: Nov. 20, 2000

(30) Foreign Application Priority Data

Nov. 30, 1999 (JP) ..... 11-339670

(51) Int. Cl.[7] ..... B21B 31/10

(52) U.S. Cl. ..... 72/239

(58) Field of Search ..... 72/238, 239, 448

(56) References Cited

U.S. PATENT DOCUMENTS 3,698,226 A * 10/1972 Eibe ..... 72/239
3,837,201 A * 9/1974 Maltby ..... 72/239

FOREIGN PATENT DOCUMENTS

JP 62-3813 * 1/1987 ..... 72/239

* cited by examiner

*Primary Examiner*—Lowell A. Larson

(57) ABSTRACT

In a roll changing apparatus of a rolling mill, a stationary roll changing table is provided on a front surface of a work side of the rolling mill. Pull-out rails and upwardly and downwardly movable shift rails are provided on the roll changing table. Shift blocks are provided for detachably attaching to a work roll assembly which has been pulled out, to move the work roll assembly sideways in a shifting direction. Only the work roll assembly to be pulled out can be shifted easily, and replaced with a new work roll assembly without the use of an elaborate foundation structure. Thus, work rolls can be changed swiftly.

4 Claims, 13 Drawing Sheets

ROLL CHANGING APPARATUS OF ROLLING MILL

BACKGROUND OF THE INVENTION

1. Field of the Invention

This invention relates to a roll changing apparatus of a rolling mill.

2. Description of the Related Art

The outline of a conventional roll changing device in a 4-roll type rolling mill will be described with reference to FIG. 11. FIG. 11 shows a concept of a conventional roll changing device called a 3-roll cluster type. As shown in this figure, a work roll assembly 3, composed of an upper work roll 1 and a lower work roll 2 equipped with chocks, is supported by upper and lower backup rolls 4 and 5. The upper and lower backup rolls 4 and 5, and the work roll assembly 3 are borne on a sled liner 6, and the sled liner 6 is supported by a pair of rails 7 in such a manner as to be admissible into and removable from a work side relative to a rolling mill 8. A floor surface of the rolling mill 8 is level with the position of the lower work roll 2. In an underfloor portion on the work side of the rolling mill 8, a space for moving the sled liner 6 and the lower backup roll 5 is formed in a ditch-like shape.

To change the upper work roll 1 and the lower work roll 2, the upper backup roll 4 is detached or lifted, while the lower backup roll 5 and the work roll assembly 3 are being borne together on the sled liner 6 in the rolling mill 8. Also, the sled liner 6 is pulled out onto the work side by driving means (not shown) for moving the sled liner 6 into and with respect to the rolling mill 8. At the pulled out position, the work roll assembly 3 on the lower backup roll 5 is detached and removed by a crane or the like. An alternative new or repaired work roll assembly 3 is placed on the lower backup roll 5, and the sled liner 6 is pulled into the rolling mill 8.

In the 3-roll cluster type roll changing device, the width of the under floor ditch on the work side (i.e., the width in the plate passing direction) is nearly equal to the width of the rolling mill 8. Thus, the work roll assembly 3 can be changed in a narrow space without the need to enlarge the space between the ditch and the rolling mill 8. Each time the upper work roll 1 and the lower work roll 2 are to be changed, however, the lower backup roll 5 needs to be pulled out of the rolling mill 8 by the sled liner 6. Furthermore, a crane or the like is used to change the work roll assembly 3, thus requiring a long time for the roll change.

Under these circumstances, a roll changing device of a so-called turn table type as shown in FIG. 12, or a roll changing device of a so-called side shift type as shown in FIG. 13 has been used. FIG. 12 shows the concept of the turn table type roll changing device, while FIG. 13 shows the concept of the side shift type roll changing device. The members identical to the rolling mill 8 shown in FIG. 11 are assigned the same reference numerals, and duplicate explanations are omitted.

As shown in FIG. 12, a moving frame 14 having a turn table 11, mounted thereto and being movable in the direction of an arrow A, is provided on the work side of a rolling mill 8. At positions on both sides of the center of rotation on the turn table 11, retracting rails 12, 13 for a work roll assembly 3 are provided in two parallel lines. The work roll assembly 3 can be carried from one of the retracting rails into the rolling mill 8, or from the rolling mill 8 into the one retracting rail.

Changing of an upper work roll 1 and a lower work roll 2 by the turn table type roll changing device is performed in the following manner: The worn-out, old work roll assembly 3 is pulled out of the rolling mill 8, and brought onto one of the retracting rails (rail 12) on the turn table 11 that has stopped coaxially with the work roll assembly 3. A new or repaired work roll assembly 3*a* is brought from the work side indicated by an arrow B onto the other retracting rail 13. In this state, the turn table 11 is horizontally turned 180 degrees to interchange the positions of the retracting rails 12 and 13. Then, the new or repaired work roll assembly 3*a* on the retracting rail 13 is drawn into the rolling mill 8. Whereas the old work roll assembly 3 on the retracting rail 12 is taken out to the work side indicated by the arrow B. A lower backup roll 5 is changed by moving the moving frame 14, which has the turn table 11 mounted thereto, in the direction of an arrow A to expose a retracting table (not shown) for changing of the lower backup roll 5 in a space between the rolling mill 8 and the moving frame 14, and replacing the old lower backup roll 5 with a new lower backup roll 5. With the turn table type roll changing device, the work rolls can be changed swiftly by operating the turn table 11.

As shown in FIG. 13, the side shift type roll changing device has a plurality of (two in the illustrated example) side shift tables 16 and 17 provided on a work side of a rolling mill 8 in such a manner as to be movable parallel to the passing direction of a plate. Changing of an upper work roll 1 and a lower work roll 2, according to the side shift type roll changing device, is performed in the following manner: One of the side shift tables, table 16, is stopped at a position facing a work roll assembly 3 of the rolling mill 8, and a worn-out, old work roll assembly 3 is retracted onto the side shift table 16. On the side shift table 17 adjacent to the side shift table 16, a new or repaired work roll assembly 3*a* has been placed. The side shift table 16 is freed from the position in front of the rolling mill 8, and then the side shift table 17 is moved to the position in front of the rolling mill 8 and stopped there. In this state, the new or repaired work roll assembly 3*a* on the side shaft table 17 is drawn into the rolling mill 8, while the old work roll assembly 3 on the side shift table 16 is taken out to the work side. Changing of a lower backup roll 5 is performed as follows: A ditch-like foundation is formed below a moving path for the side shift tables 16 and 17. A table (not shown) for changing the lower backup roll 5 is provided in the ditch-like foundation. The side shift tables 16, 17 are freed from the position facing the rolling mill 8, and the lower backup roll 5 is changed. With the side shift type roll changing device, like the turn table type roll changing device, the work rolls can be changed swiftly by a moving operation of the side shift tables 16, 17.

According to the turn table type roll changing device, the work rolls can be changed swiftly by operating the turn table 11. However, the turn table. 11 and the moving frame 14 are elaborate in configuration, and the foundation requires a special design, increasing the equipment cost. According to the side shift type roll changing device, the work rolls can be changed swiftly by a moving operation of the side shift tables 16, 17. However, there is need to consider a table shift space for retreat of the side shift tables 16, 17 during changing of the backup roll. This also requires an elaborately configured device, increasing the equipment cost.

In addition, the turn table type roll changing device and the side shift type roll changing device enable the work rolls to be changed more swiftly compared with the three-roll cluster type roll changing device. Thus, it is demanded to modify the existing three-roll cluster type roll changing device into the turn table type or the side shift type. However, this requires that the foundation be upsized markedly, or an elaborate device be mounted. Thus, the modification of the existing three-roll cluster type roll changing device requires huge manpower, labor hours, and costs, and has not been easy.

SUMMARY OF THE INVENTION

The present invention has been accomplished in light of the foregoing situations. An object of the present invention is to provide a roll changing apparatus of a rolling mill capable of swiftly changing work rolls without using elaborate devices. A particular object of the invention is to provide a roll changing apparatus of a rolling mill, which can be installed without requiring a marked modification of equipment in the existing three-roll cluster type roll changing device.

A first aspect of the invention is a roll changing apparatus of a rolling mill, comprising:

a pull-out rail, provided on a front surface of a work side of the rolling mill, for pulling out a work roll assembly;

a shift rail extending in a direction intersecting with the pull-out rail; and shifting/driving means for moving the work roll assembly, which has been pulled out along the pull-out rail to an intersection of the pull-out rail and the shift rail, in a shifting direction along the shift rail.

According to this aspect, it is possible to move only the pulled-out work roll assembly easily in the shifting direction, without providing a turn table or shifting a table bearing a work roll assembly. As a result, a simple foundation structure permits replacement of the work roll assembly. That is, the old work roll assembly can be easily replaced by a new work roll assembly without the use of an elaborate foundation structure, so that the work rolls can be changed swiftly. Furthermore, there is no need for a wide installation area for the provision of a turn table or the shift of a table itself, and complicated foundation work is unnecessary. Thus, the roll changing apparatus of the present invention can be installed without the need for a marked modification of the existing rolling equipment, especially, the equipment of a three-roll cluster type roll changing device.

In the first aspect of the invention, the pull-out rail and the shift rail may be provided in such a manner as to intersect on a same plane, and at least the shift rail may be provided with a support member for movably supporting the work roll assembly. Thus, roll changing work can be done swiftly using a simple configuration.

In the first aspect of the invention, moreover, the pull-out rail and the shift rail may be provided in such a manner as to intersect on vertically different planes, and a site of the pull-out rail at an intersection in a plan direction of the pull-out rail and the shift rail may be composed of a moving bogie which supports the work roll assembly and which is moved along the shift rail by the shifting/driving means. Thus, the work roll assembly can be moved in the shifting direction by the movement of the moving bogie, so that roll changing work can be done swiftly using a simple configuration.

A second aspect of the present invention is a roll changing apparatus of a rolling mill, comprising:

a pull-out rail, provided on a front surface of a work side of the rolling mill, for pulling out a work roll assembly;

a shift rail movable in upward and downward directions, and extending in a direction intersecting with the pull-out rail;

hoisting/lowering driving means for lowering the shift rail at a time of pulling-out of the work roll assembly, and for hoisting the shift rail after the work roll assembly is pulled out along the pull-out rail as far as an intersection of the pull-out rail and the shift rail; and shifting/driving means for moving the work roll assembly in a shifting direction along the shift rail when the work roll assembly has been pulled out to the intersection of the pull-out rail and the shift rails, and the shift rail has been hoisted.

According to this aspect, it becomes possible to move only the pulled-out work roll assembly easily in the shifting direction, without providing a turn table or shifting table bearing a work roll assembly. As a result, a simple foundation structure permits replacement of the work roll assembly. That is, the old work roll assembly can be easily replaced by a new work roll assembly without the use of an elaborate foundation structure, so that the work rolls can be changed swiftly.

In the first or second aspect of the present invention, the rolling mill may be provided with a lower backup roll for supporting a lower work roll, a ditch-like foundation for pulling out the lower backup roll may be provided on the front surface of the work side of the rolling mill nearly in correspondence with a width of the rolling mill, a table member may be detachably provided in the foundation, and the roll changing apparatus may be installed on the table member. Thus, by detaching the table member, the lower backup roll can also be replaced swiftly and easily.

The table member may be supported movably along a direction of pulling-out of the lower backup roll, and moving means for moving the table member may be provided. Thus, the table member can be detached quickly, and the lower backup roll can be replaced more easily. Besides, lower backup roll pulling-out/driving means for pulling out the lower backup roll may be provided, and the lower backup roll pulling-out/driving means may be applied as the moving means. Thus, the table member can be retreated in conjunction with the lower backup roll, and the lower backup roll can be replaced more easily.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A roll changing apparatus of a rolling mill according to preferred embodiments of the present invention will now be described with reference to the accompanying drawings, but it should be understood that the invention is not restricted thereby. The roll changing apparatus of the present invention is a technology which can be easily applied to a newly constructed apparatus, and which is easily applicable particularly in modifying the conventional three-roll cluster type roll changing device shown in FIG. 11.

Figure 1:
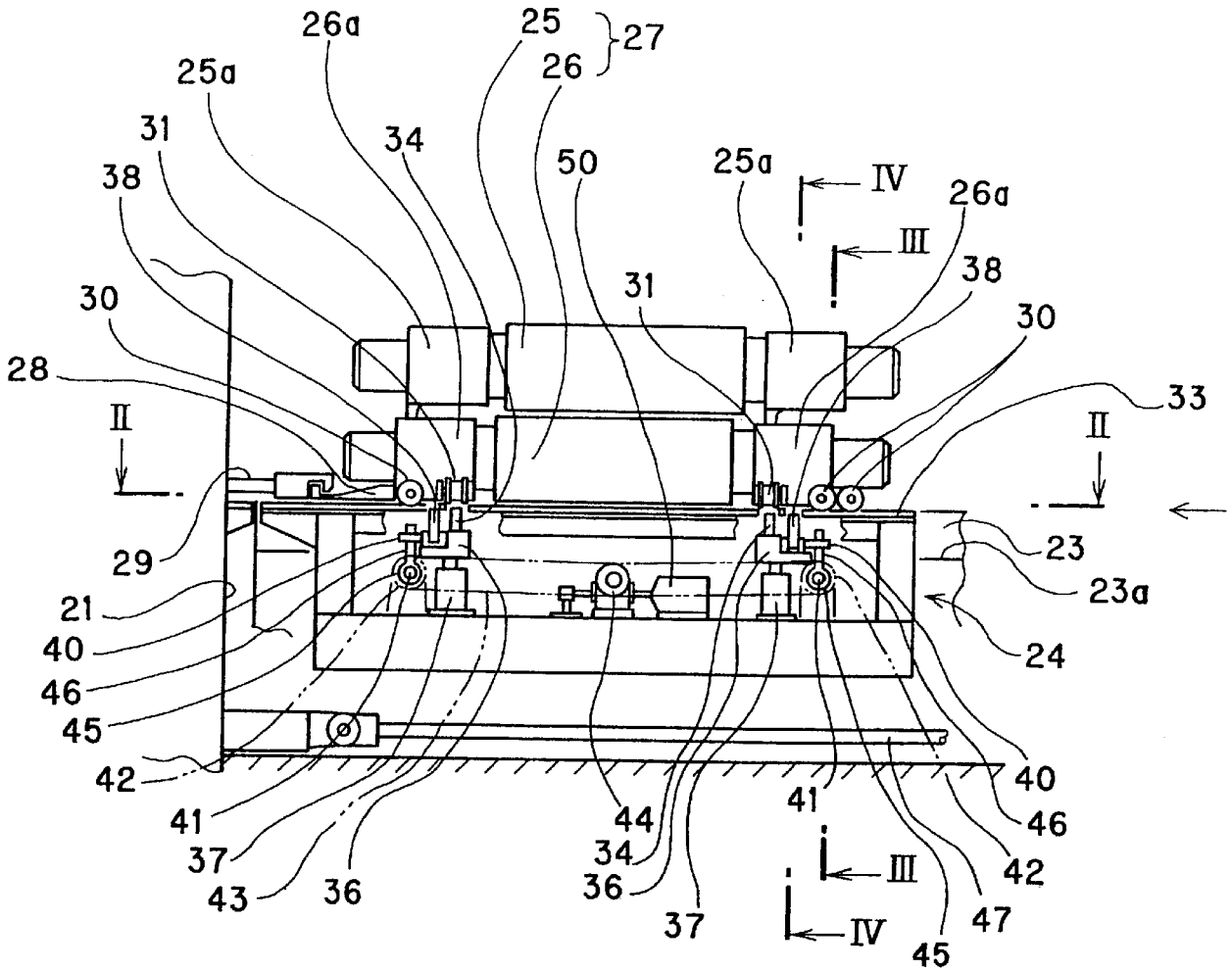
FIG. 1 is a side sectional view of a roll changing apparatus according to a first embodiment of the present invention.
Figure 2:
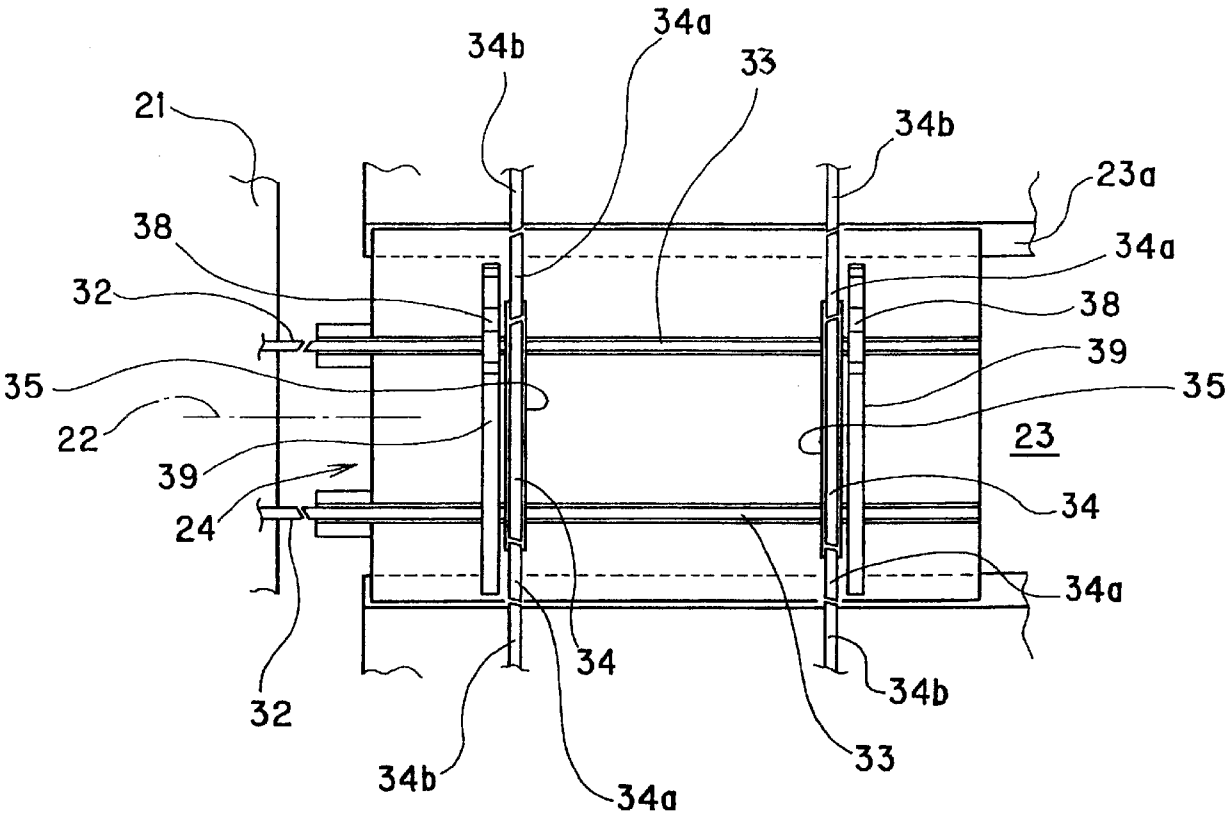
FIG. 2 is a view taken on line II—II of FIG. 1.
Figure 3:
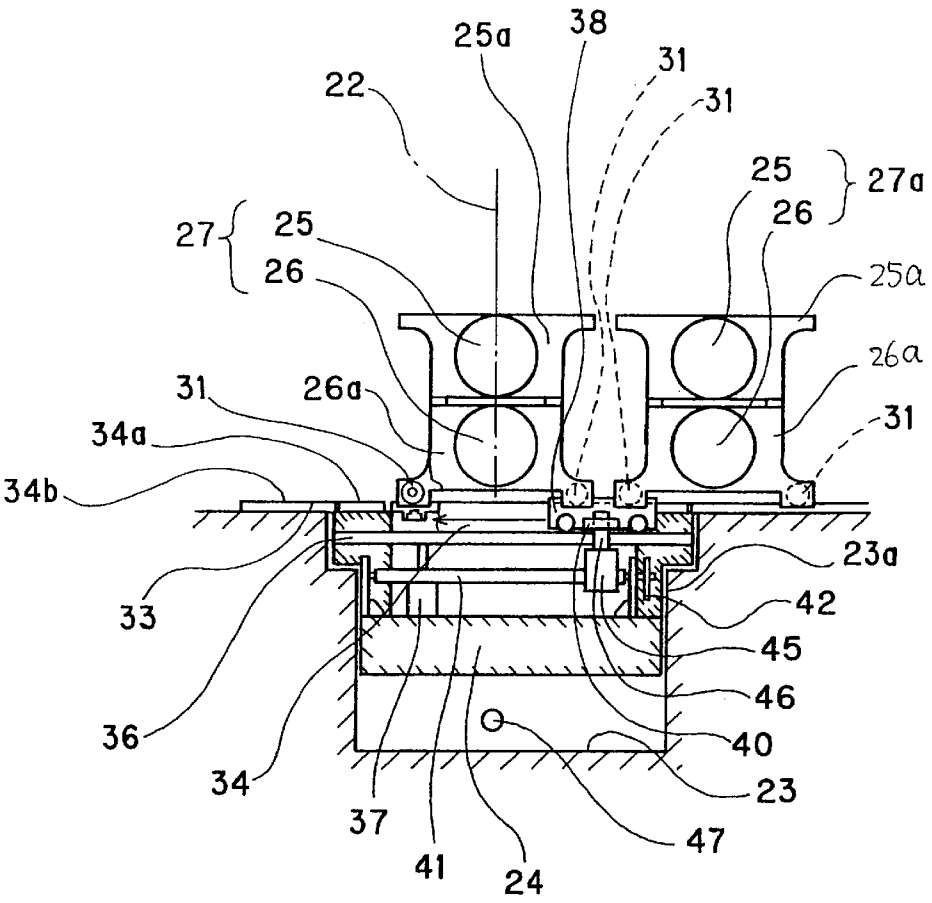
FIG. 3 is a view taken on line III—III of FIG. 1.
Figure 4:
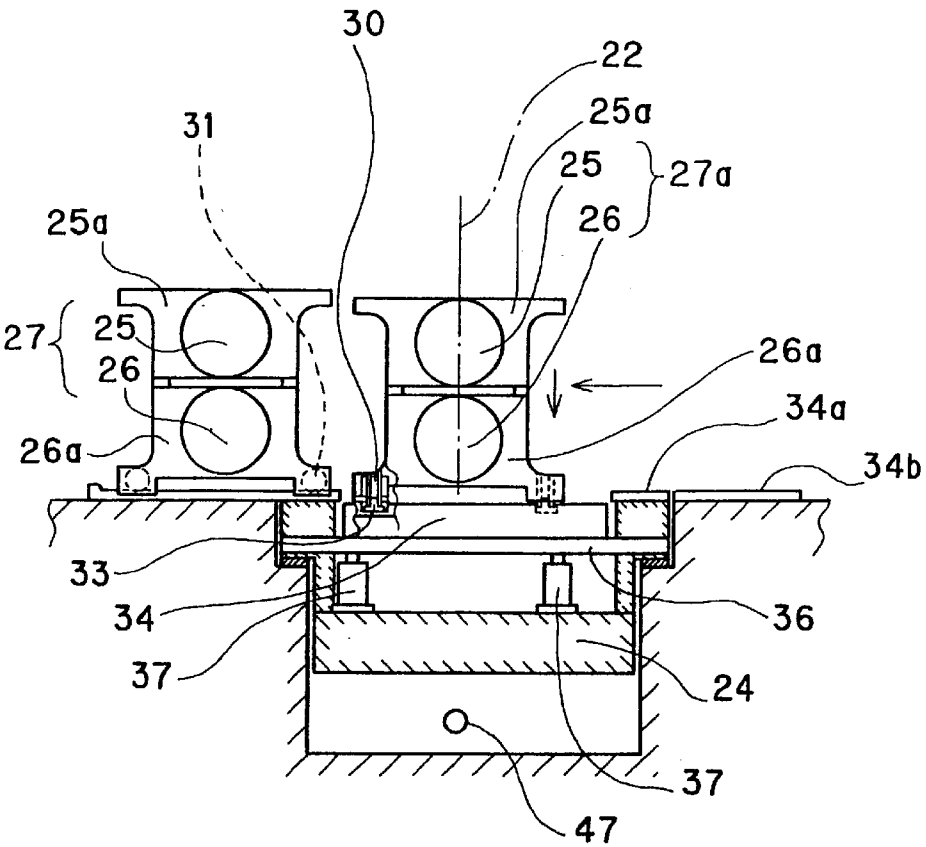
FIG. 4 is a view taken on line IV—IV of FIG. 1.

FIG. 1 shows a side section of a roll changing apparatus according to a first preferred embodiment of the present invention. FIG. 2 shows a view taken along line II—II of FIG. 1. FIG. 3 shows a situation at start of shift, as viewed along line III—III of FIG. 1. FIG. 4 shows a situation at completion of shift, as viewed along line IV—IV of FIG. 1.

Figure 11:
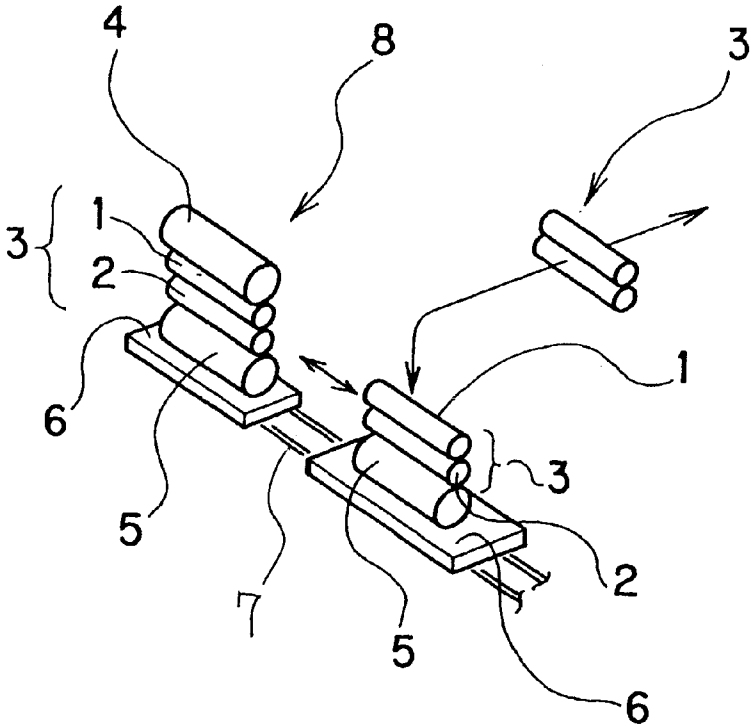
FIG. 11 is a concept view of a conventional roll changing device.
Figure 12:
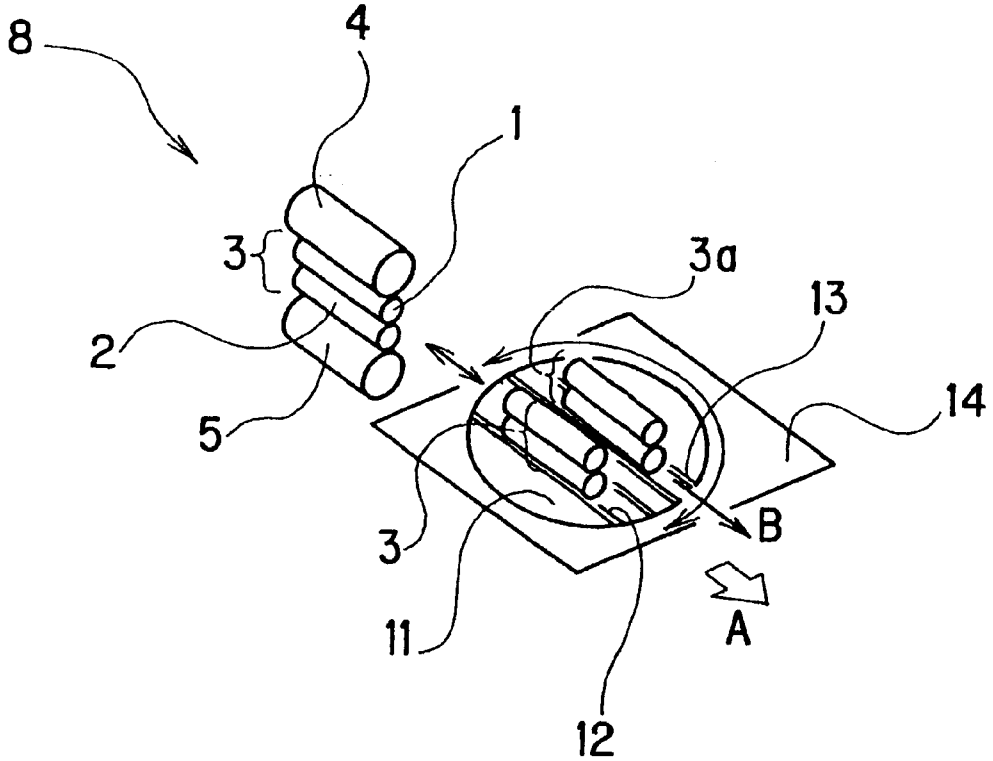
FIG. 12 is a concept view of a conventional roll changing device.
Figure 13:
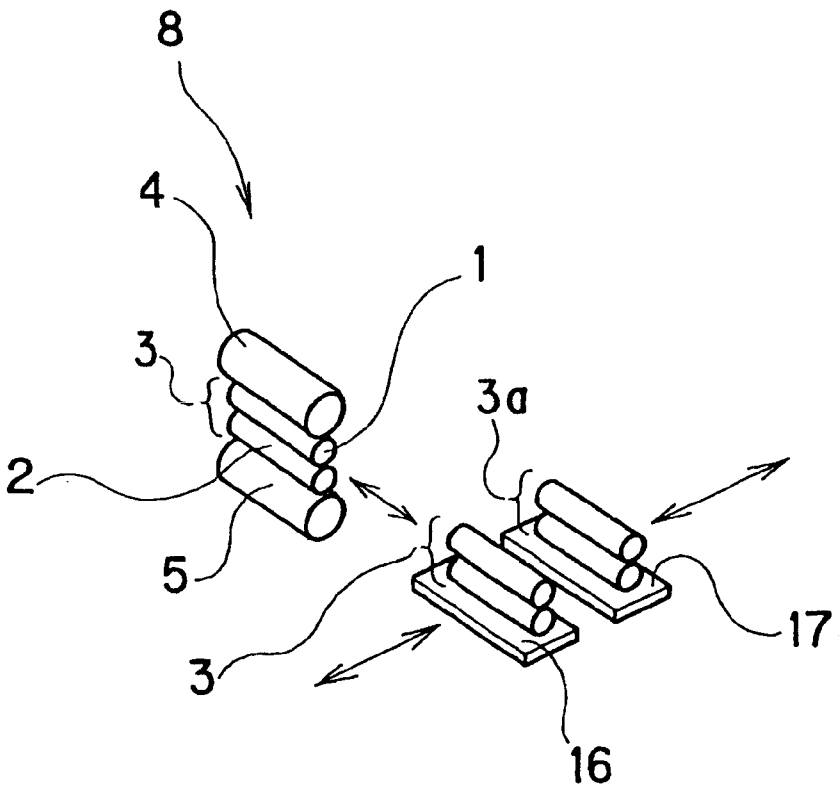
FIG. 13 is a concept view of a conventional roll changing device.

As shown in the drawings, a ditch-like foundation 23 is formed on a work side of a rolling mill 21 in such a manner as to face a roll center 22. The width of the ditch-like foundation 23 is nearly the same as the width of the rolling mill 21, and steps 23*a* extending perpendicularly with respect to a rolling line are provided in the ditch-like foundation 23. The width of the ditch-like foundation 23 is set to be nearly the same as the width of the foundation for changing the lower backup roll in the conventional three-roll cluster type roll changing device as shown in FIG. 11. In the ditch-like foundation 23, a work roll changing table (roll changing table) 24 is stationarily supported with the steps 23*a* as support surfaces. On the roll changing table 24, a work roll assembly 27, composed of an upper work roll 25 and a lower work roll 26 equipped with chocks 25*a*, 26*a*, is to be placed. FIG. 1 shows a state in which the work roll assembly 27 has been pulled out and borne on the roll changing table 24. The rolling mill 21 is provided with upper and lower backup rolls as in a conventional technology, although they are not shown.

At an end of the lower chock 26*a* on a drive side, a hook 28 is provided. The hook 28 is attached to and detached from the end of a roll push-out rod 29 provided on the rolling mill 21. The roll push-out rod 29 is extended or contracted, whereby the work roll assembly 27 is pushed out (pulled out) onto the roll changing table 24, or conversely, pulled into the rolling mill 21. On both sides of the drive side of the lower chock 26*a* of the work roll assembly 27, a pair of pull-out/pull-in wheels (pull-out wheels) 30 are provided which rotate in a roll axis direction. Also, on both sides of the lower chock 26*a*, a pair of shifting wheels 31 are provided which are adjacent to the pull-out wheels 30 and which rotate in a lateral direction perpendicular to the roll axis direction at a position slightly higher than the pull-out wheels 30. Similarly, on both sides of a work side of the lower chock 26*a* of the work roll assembly 27, a pair of pull-out wheels 30 and a pair of shifting wheels 31 are provided.

On an upper surface of the roll changing table 24, a pair of parallel pull-out rails 33 are fixedly disposed in alignment with work roll pull-in rails 32 provided in the rolling mill 21. The pull-out wheels 30 roll on the pull-out rails 33. The shifting wheels 31 are provided at a height at which the shifting wheels 31 can move in a shifting direction without interfering with the pull-out rails 33.

On the upper surface of the roll changing table 24, a pair of shift rails 34, as upwardly and downwardly movable shift rails, are provided. The shift rails 34 come into detachable contact with the shifting wheels 31 of the lower chocks 26*a* at predetermined positions. The shift rails 34 are provided at right angles with respect to the pull-out rails 33, and can be moved upward and downward through holes 35 in the upper surface of the roll changing table 24 and through the pull-out rails 33. On the upper surface of the roll changing table 24 and on the upper surface of the ditch-like foundation 23, fixed shift rails 34*a*, 34*b* are provided as shifting rails. The fixed shift rails 34*a*, 34*b* align with the shift rail 34 at a height to which the shift rail 34 has been lifted by a predetermined distance. The upwardly and downwardly movable shift rail 34 ascends through the hole 35 formed in the upper surface of the roll changing table 24, contacts the shifting wheel 31 of the chock 26*a*, and further pushes up the work roll assembly 27 to a height at which the pull-out wheel 30 has left the pull-out rail 33. At the height to which the shift rail 34 has pushed up the work roll assembly 27, the shift rail 34 aligns with the fixed shift rails 34*a*, 34*b*. The two shift rails 34 are each fixed to an L-shaped beam 36. Inside the roll changing table 24, two hydraulic cylinders 37 are provided as hoisting/lowering driving means for driving the L-shaped beams 36 to be hoisted or lowered. At a horizontal portion of the L-shaped beam 36, a shift block 38 is provided movably along the shift rail 34, and the shift block 38 is adapted to ascend and descend along with the shift rail 34. The shift block 38, at its ascending position, is fitted to the chock 26*a* of a new or old work roll assembly 27.

In the upper surface of the roll changing table 24, holes 39 for allowing the ascent and descent of the shift block 38 are provided in a lateral range beyond the pull-out rails 33. The shift block 38 is movable on the horizontal portion of the L-shaped beam 36 by four wheels. On a side surface of the shift block 38, an eye plate 40 is fixed which juts out horizontally and which has a hole formed therein. Inside the roll changing table 24, threaded shafts 41, extending parallel to the L-shaped beams 36 in correspondence with the L-shaped beams 36, are rotatably supported. To ends of the threaded shafts 41, sprockets 42 are fixed. A chain 43 is looped between the sprockets 42, and a drive sprocket 44 is engaged with the chain 43 (see FIG. 1). The drive sprocket 44 is driven by a motor 50, and driving the motor 50 rotationally drives the threaded shafts 41 synchronously via the drive sprocket 44, chain 43, and the sprockets 42.

A nut 45 is screwed onto each threaded shaft 41, and a vertical pin 46 is provided integrally with each nut 45. The vertical pin 46 is inserted through the hole of the eye plate 40 to restrict movement only in a vertical direction. That is, the normal or reverse driving of the motor 50 rotates the threaded shafts 41, whereupon the nuts 45 move along the threaded shafts 41. The shift blocks 38 synchronize via the vertical pins 46 and the eye plates 40, and move on the L-shaped beams 36 in a reciprocating manner. The movements of the shift blocks 38 cause the work roll assembly 27, fitted to the shift blocks 38 via the chocks 26*a*, to move in a shifting direction along the shift rails 34 and the fixed shift rails 34*a*, 34*b*. The L-shaped beam 36 is adapted to ascend and descend along with the shift rail 34, while the vertical pin 46 keeps an inserted state without escaping from the hole of the eye plate 40.

Alternatively, the shift block 38 need not be provided on the L-shaped beam 36, but can be provided on the roll changing table 24 in such a manner as to be stationary in the height direction, and movable only in a direction along the shift rail 34. In this case, the vertical pin 46 and the shift block 38 (eye plate 40) are in a fixed state, and when the work roll assembly 27 is to be pulled out, the shift block 38 is located at a predetermined position. A notch or the like is provided at this position at which the pull-out wheel 30 does not interfere.

On a chock of the lower backup roll (not shown), pulling-out/driving means 47 is provided for pulling out the lower backup roll.

In the above-described embodiment, the driving for hoisting and lowering the shift rail 34 is performed using the hydraulic cylinder 37, but may be carried out by use of other driving means. Further in this embodiment, the shift block 38, as the shifting/driving means, is moved via the motor 50, drive sprocket 44, chain 43, sprocket 42, threaded shaft 41, nut 45, vertical pin 46, and eye plate 40. However, other driving means may be used as the shifting/driving means.

Changing of the work rolls according to the foregoing roll changing apparatus will be described. In FIG. 3, the reference numeral 27 denotes an old work roll assembly, having chocks 25*a*, 26*a*, which was pulled out from the rolling mill 21 onto the roll changing table 24. The reference numeral 27*a* denotes a new or repaired work roll assembly equipped with chocks 25*a*, 26*a*. In parallel with or in advance to pulling out the old work roll assembly 27 onto the roll changing table 24, the new work roll assembly 27*a* is placed on the fixed shift rails 34*a*, 34*b* on the roll changing table 24. The shift block 38 is brought to a position bridging the gap between the chock 26*a* of the pulled-out work roll assembly 27 and the chock 26*a* of the new work roll assembly 27*a* positioned adjacently. The hydraulic cylinders 37 are driven to extend, thereby raising the upwardly and downwardly movable shift rails 34 and shift blocks 38 to a predetermined height via the beams 36. In accordance with this raising, the shift block 38 is fitted into the gap between the chock 26*a* on one side of the old work roll assembly 27 and the chock 26*a* on one of the new work roll assembly 27*a*. Also, the shifting wheels 31 ride on the shift rails 34, whereby the work roll assemblies 27, 27*a* ascend, and the pull-out wheels 30 are lifted to a height apart from the pull-out rails 33 (the state of FIG. 3). The motor 50 is driven to rotate the two threaded shafts 41 synchronously via the drive sprocket 44, chain 43, and sprockets 42, thereby moving the shift block 38 in a leftward direction in FIG. 3. As a result, the old and new work roll assemblies 27 and 27*a* are moved leftward. The new work roll assembly 27*a* is stopped to align with the position of the roll center 22 of the rolling mill 21. The hydraulic cylinders 37 are contracted, to lower the upwardly and downwardly movable shift rail 34 and shift block 38 via the beam 36. In accordance with this lowering, the pull-out wheels 30 of the new work roll assembly 27*a* ride on the pull-out rails 33, and the shift block 38 leaves the chocks 26*a* of the old and new work roll assemblies 27 and 27*a* (state of FIG. 4). In this state, the new work roll assembly 27*a* is pulled into the rolling mill 21 from the site on the roll changing table 24, while the old work roll assembly 27 is pulled out to the work side. By this procedure, changing of the work rolls is completed. When the lower backup roll of the rolling mill 21 is to be changed, the roll changing table 24 is moved by a crane or the like in a direction of separation from the rolling mill 21. Thus, an open space facing the lower backup roll is created on the work side of the rolling mill 21, and changing of the lower backup roll is performed using the open space.

With the foregoing roll changing apparatus, it is possible to move only the pulled-out work roll assembly easily in the shifting direction, without providing a turn table or shifting a table bearing a work roll assembly. As a result, a simple foundation structure permits replacement of the work roll assembly. That is, the old work roll assembly can be easily replaced by a new work roll assembly without the use of an elaborate foundation structure, so that the work rolls can be changed swiftly. Furthermore, there is no need for a wide installation area for provision of a turn table or for the shift of a table itself, and complicated foundation work is unnecessary. Thus, the roll changing apparatus of the invention can be installed without the need for a marked modification of the existing rolling equipment, especially, the equipment of the three-roll cluster type roll changing device as shown in FIG. 11.

Figure 5:
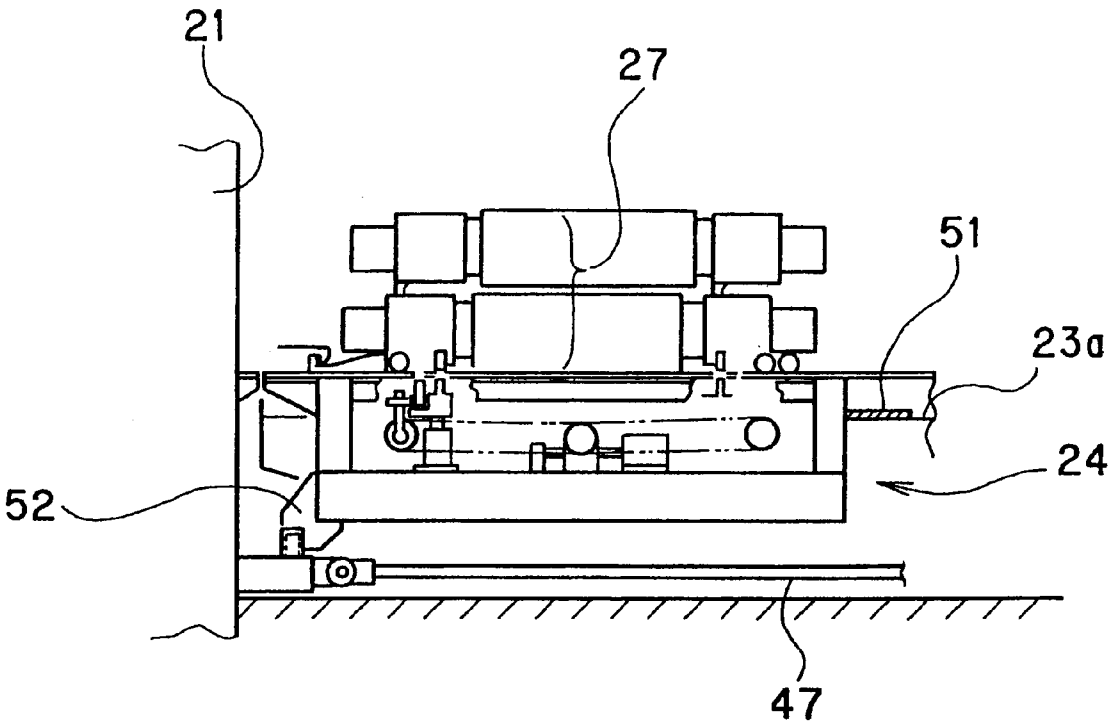
FIG. 5 is a side view of a roll changing apparatus according to a second embodiment of the present invention.

A roll changing apparatus according to a second preferred embodiment of the present invention will be described based on FIG. 5, which shows a side view of the roll changing apparatus according to the second preferred embodiment of the invention. The same members as the members in the apparatus shown in FIGS. 1 to 4 will be assigned the same reference numerals, and duplicate explanations will be omitted.

As shown in the drawing, a slide material 51 is laid on a step 23*a* of a ditch-like foundation 23. A roll changing table 24 is disposed in a stationary state slidably in a longitudinal direction (a right-and-left direction in FIG. 5) of the step 23*a* via the slide material 51. The roll changing table 24 is provided with a connecting member 52, which is connected to pulling-out/driving means 47 for pulling out a lower backup roll.

With the roll changing apparatus according to the second embodiment, the work roll assembly is changed in the same manner as in the first embodiment. When the lower backup roll is pulled out by driving the pulling-out/driving means 47 after completion of the roll change, the stationary roll changing table 24 is retreated in an interlocked manner in a pull-out direction along the step 23*a* of the ditch-like foundation 23 via the connecting member 52 and the slide material 51. Thus, roll changing work for the lower backup roll can also be done very easily and swiftly.

Figure 6:
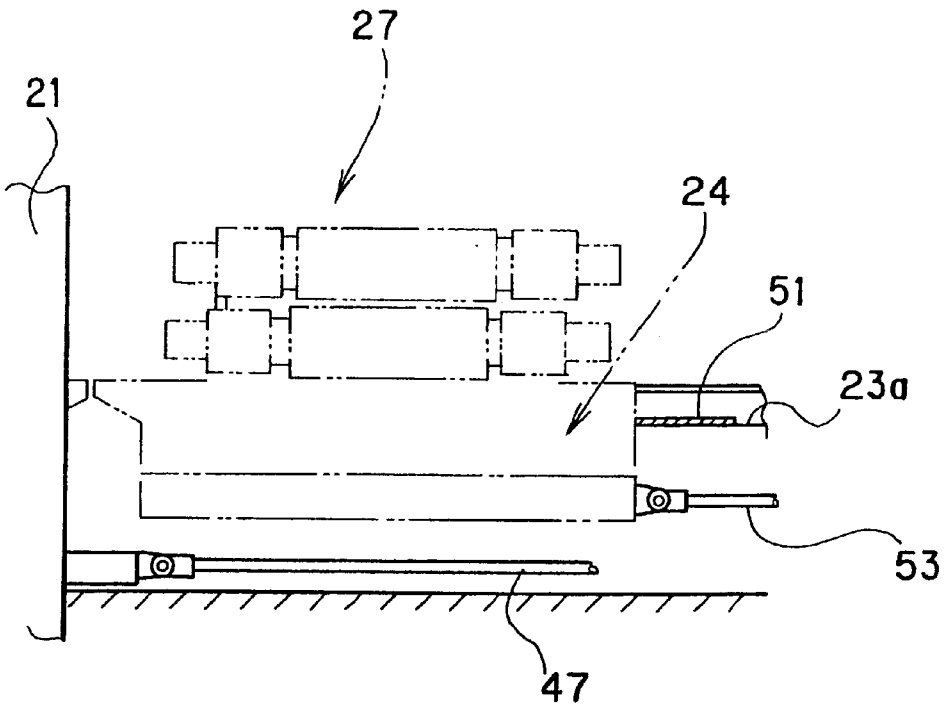
FIG. 6 is a side view of a roll changing apparatus according to a third embodiment of the present invention.

A roll changing apparatus according to a third preferred embodiment of the present invention will be described based on FIG. 6, which shows a side view of the roll changing apparatus according to the third preferred embodiment of the invention. The same members as the members in the apparatus shown in FIGS. 1 to 5 will be assigned the same reference numerals, and duplicate explanations will be omitted.

As shown in the drawing, a slide material 51 is laid on a step 23*a* of a ditch-like foundation 23. A roll changing table 24 is disposed in a stationary state slidably in a longitudinal direction (right-and-left directions in FIG. 6) of the step 23*a* via the slide material 51. The roll changing table 24 is provided with dedicated retreat driving means 53. The roll changing table 24 is moved away from a rolling mill 21 by the retreat driving means 53.

With the roll changing apparatus according to the third embodiment, the work roll assembly is changed in the same manner as in the first embodiment. After completion of the roll change, a lower backup roll is pulled out by synchronous driving of pulling-out/driving means 47 and the retreat driving means 53. Simultaneously, the stationary roll changing table 24 is retreated in an interlocked manner in a pull-out direction along the step 23*a* of the ditch-like foundation 23 via the slide material 51. As noted from this, the roll changing table 24 can be retreated substantially in an interlocked manner to the lower backup roll. Thus, roll changing work for the lower backup roll can be done very easily and swiftly. Furthermore, the stationary roll changing table 24 can be quickly retreated alone, when the necessity arises for retreating the roll changing table 24 for other maintenance task.

Figure 7:
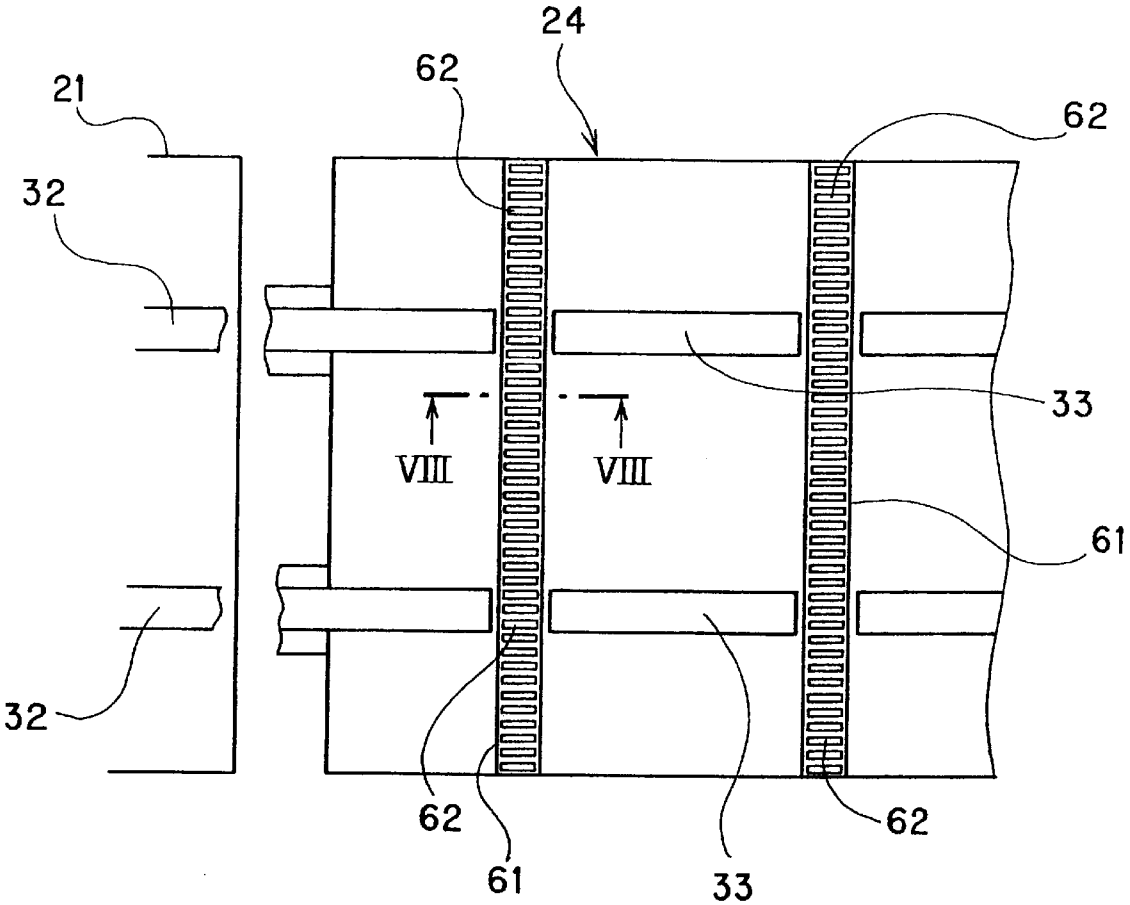
FIG. 7 is a plan view of a roll changing apparatus according to a fourth embodiment of the present invention.
Figure 8:
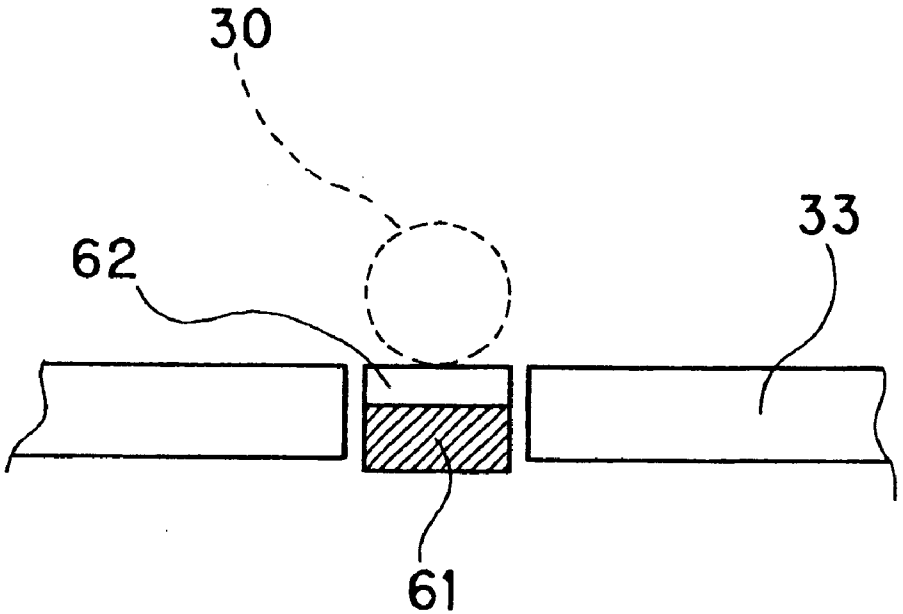
FIG. 8 is a view taken on line VIII—VIII of FIG. 7.

A roll changing apparatus according to a fourth preferred embodiment of the present invention will be described based on FIGS. 7 and 8. FIG. 7 shows a plan view of the roll changing apparatus according to the fourth preferred embodiment of the invention. FIG. 8 shows a view taken along line VIII—VIII of FIG. 7. The same members as the members of the apparatus shown in FIGS. 1 to 4 will be assigned the same reference numerals, and duplicate explanations will be omitted.

The roll changing apparatus according to the fourth embodiment is different from the first embodiment in terms of the configuration of the shift rail. As shown in the drawings, shift rails 61 are provided at right angles to pull-out rails 33 on an upper surface of a roll changing table 24. The shift rails 61 are provided in such a manner as to extend continuously and cross the pull-out rails 33. On the shift rails 61, a plurality of roller members 62 are provided as support members, and are disposed to be level with the pull-out rail 33.

With the roll changing apparatus according to the fourth embodiment, a work roll assembly is pulled out along the pull-out rails 33 by pull-out wheels 30. When the pull-out wheel 30 arrives at an intersection of the pull-out rail 33 and the shift rail 61, the pull-out wheel 30 rides on the roller member 62 of the shift rail 61. When, in this state, the work roll assembly is moved by shifting/driving means (not shown) in a direction along the shift rail 61, the pull-out wheel 30 moves along the shift rail 61 in accordance with the rolling of the roller member 62. Thus, the work roll assembly can be moved in the shifting direction without the need to hoist or lower the shift rails 61, or to provide chocks with shifting wheels. Hence, roll changing work can be done swiftly with the use of a simple configuration.

As the driving means for driving the work roll assembly in a direction along the shift rail 61, any well known means may be applied as necessary. It is also possible to detect that the pull-out wheel 30 has sat on the roller member 62 of the shift rail 61, and to move the work roll assembly automatically in a direction along the shift rail 61. Alternatively, roller members may be provided on the pull-out rails 33, the pull-out wheels 30 may be omitted, and the work roll assembly may be pulled out and shifted by rolling of the roller members.

Figure 9:
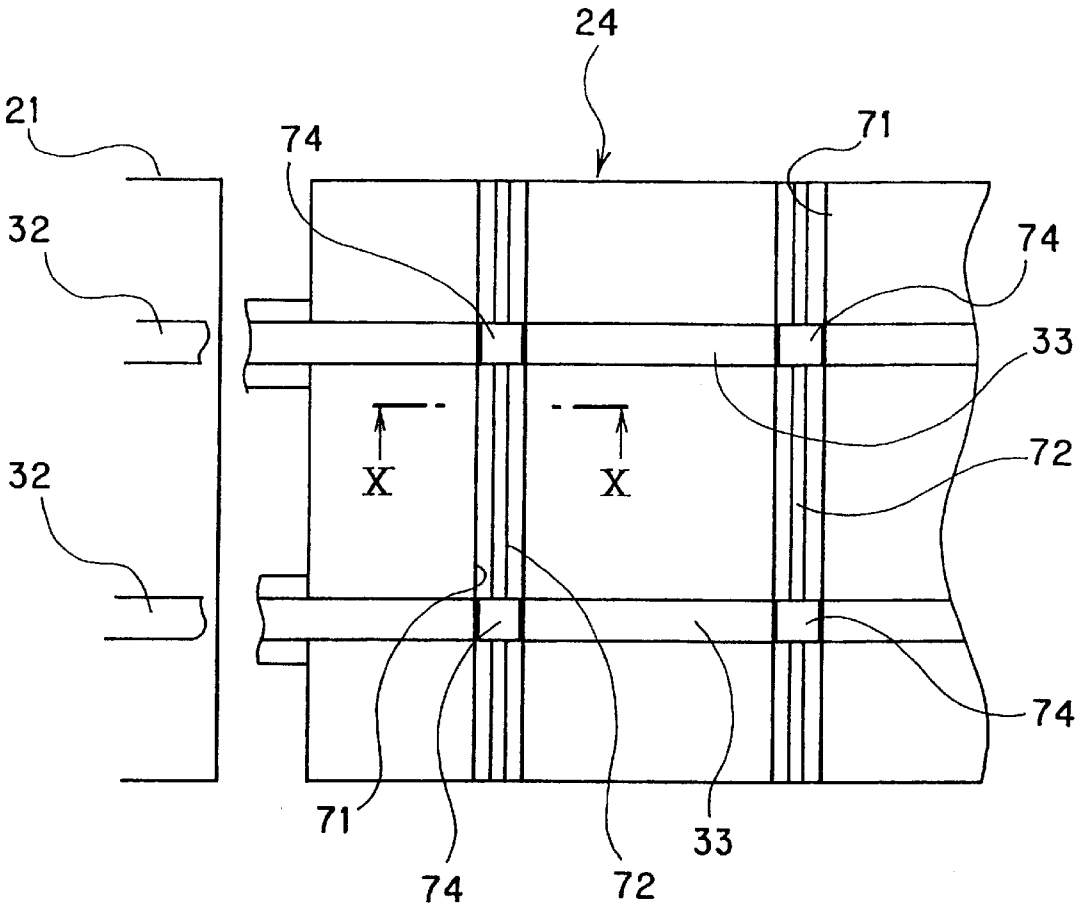
FIG. 9 is a plan view of a roll changing apparatus according to a fifth embodiment of the present invention.
Figure 10:
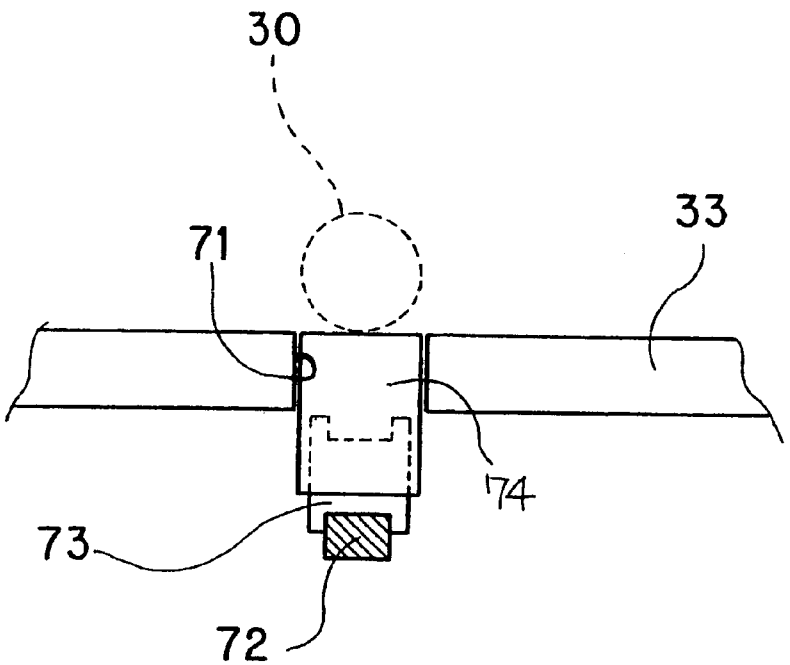
FIG. 10 is a view taken on line X—X of FIG. 9.

A roll changing apparatus according to a fifth preferred embodiment of the present invention will be described based on FIGS. 9 and 10. FIG. 9 shows a plan view of the roll changing apparatus according to the fifth preferred embodiment of the invention. FIG. 10 shows a view taken along line X—X of FIG. 9. The same members as the members of the apparatus shown in FIGS. 1 to 4 will be assigned the same reference numerals, and duplicate explanations will be omitted.

The roll changing apparatus according to the fifth embodiment is different from the first embodiment in terms of the configuration of the shift rail. As shown in the drawings, grooves 71, which cross pull-out rails 33 at right angles to the pull-out rails 33, are formed on an upper surface of a roll changing table 24. In the roll changing table 24 below the groove 71, a rail 72 extending along the groove 71 is provided. On the rails 72 at intersections (4 intersections in the drawing) of the grooves 71 and the pull-out rails 33 in a planar direction, bogies 74, as moving bogies, are supported movably via wheels 73. The upper surface of the bogie 74 is level with (coplanar with) the pull-out rail 33. That is, a shift rail is composed of the rail 72 and the bogie 74, and the site of the pull-out rail 33 at the intersection of the pull-out rail 33 and the shift rail in the planar direction comprises the bogie 74. The bogies 74 are moved synchronously by driving means (not shown).

With the roll changing apparatus according to the fifth embodiment, a work roll assembly is pulled out along the pull-out rails 33 by pull-out wheels 30. When the pull-out wheel 30 arrives at the intersection of the pull-out rail 33 and the shift rail, the pull-out wheel 30 rides on the bogie 74. When, in this state, the bogies 74 are moved synchronously along the rails 72 by shifting/driving means (not shown), the work roll assembly is moved in the shifting direction, with the pull-out wheels 30 on board the bogies 74. Thus, the work roll assembly can be moved in the shifting direction by moving the bogies 74, without the need to hoist or lower the shift rails, or to provide chocks with shifting wheels. Hence, roll changing work can be done swiftly with the use of a simple configuration.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A roll changing apparatus of a rolling mill, comprising:

a pull-out rail, provided on a front surface of a work side of the rolling mill, for pulling out a work roll assembly;

a shift rail movable in upward and downward directions, and extending in a direction intersecting with the pull-out rail;

hoisting/lowering driving means for lowering the shift rail at a time of pulling-out of the work roll assembly, and for hoisting the shift rail after the work roll assembly is pulled out along the pull-out rail as far as an intersection of the pull-out rail and the shift rail; and shifting/driving means for moving the work roll assembly in a shifting direction along the shift rail when the work roll assembly has been pulled out to the intersection of the pull-out rail and the shift rail, and the shift rail has been hoisted.

2. A roll changing apparatus of a rolling mill as claimed in claim 1, wherein the rolling mill is provided with a lower backup roll for supporting a lower work roll, a ditch-like foundation for pulling out the lower backup roll is provided on the front surface of the work side of the rolling mill nearly in correspondence with a width of the rolling mill, a table member is detachable provided in the foundation, and the roll changing apparatus is installed on the table member.

3. A roll changing apparatus of a rolling mill as claimed in claim 2, wherein the table member is supported movably along a direction of pulling-out of the lower backup roll, and moving means for moving the table member is provided.

4. A roll changing apparatus of a rolling mill as claimed in claim 3, wherein lower backup roll pulling-out/driving means for pulling out the lower backup roll is provided, and the lower backup roll pulling-out/driving means is applied as the moving means.

* * * * *